US011198288B2

(12) United States Patent
Fehlner et al.

(10) Patent No.: US 11,198,288 B2
(45) Date of Patent: Dec. 14, 2021

(54) METHOD FOR ASSESSING THE CONDITION AND IMPROVING THE PRINTING QUALITY OF PRINTING NOZZLES IN PRINTHEADS OF AN INKJET PRINTING MACHINE AND IMPROVED PRINTING NOZZLE TEST CHART

(71) Applicant: Heidelberger Druckmaschinen AG, Heidelberg (DE)

(72) Inventors: Andreas Fehlner, Mannheim (DE); Hans Koehler, Edingen-Neckarhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/742,956

(22) Filed: Jan. 15, 2020

(65) Prior Publication Data

US 2020/0230952 A1 Jul. 23, 2020

(30) Foreign Application Priority Data

Jan. 17, 2019 (DE) ..... 102019200567

(51) Int. Cl.
*B41J 2/045* (2006.01)

(52) U.S. Cl.
CPC ..... *B41J 2/0451* (2013.01); *B41J 2/04505* (2013.01); *B41J 2/04506* (2013.01); (Continued)

(58) Field of Classification Search
CPC ..... B41J 2/04505; B41J 2/04506; B41J 2/04508; B41J 2/0451; B41J 2/04536; B41J 2/04558
See application file for complete search history.

(56) References Cited

U.S. PATENT DOCUMENTS 5,815,177 A 9/1998 Sasaki
7,086,715 B2 8/2006 Yamada
(Continued)

FOREIGN PATENT DOCUMENTS

CN 1509892 A 7/2004
CN 105479945 A 4/2016
(Continued)

*Primary Examiner* — Matthew Luu
*Assistant Examiner* — Kendrick X Liu
(74) *Attorney, Agent, or Firm* — Laurence A. Greenberg; Werner H. Stemer; Ralph E. Locher

(57) ABSTRACT

A method for assessing the condition and improving the printing quality of printing nozzles in printheads of an inkjet printing machine includes printing a nozzle test chart formed of a specific number of horizontal rows of equidistant vertical lines printed periodically underneath one another, with only every $n^{th}$ printing nozzle contributing to the test chart in every row of the test chart and n corresponding to a different number between one and the specific number of horizontal rows, recording and digitizing the test chart and analyzing the test chart regarding the condition of the contributing nozzles by using a computer. The nozzles printing horizontal lines between the horizontal rows complementing the equidistant vertical lines to form quadrangular objects used by the computer to analyze the condition of the contributing nozzles. Measures are taken to improve the printing quality of the nozzles depending on the condition of the contributing nozzles.

7 Claims, 4 Drawing Sheets

(52) U.S. Cl.
CPC ..... *B41J 2/04508* (2013.01); *B41J 2/04536* (2013.01); *B41J 2/04558* (2013.01); *B41J 2/04586* (2013.01)

(56) References Cited

U.S. PATENT DOCUMENTS

| | | | | |
|---|---|---|---|---|
| 7,198,349 | B2 | 4/2007 | Endo et al. | |
| 8,807,684 | B2 | 8/2014 | Allworth et al. | |
| 9,375,964 | B2 | 6/2016 | Koehler et al. | |
| 9,539,803 | B2 | 1/2017 | Michel et al. | |
| 10,214,017 | B2 | 2/2019 | Geissler et al. | |
| 2008/0036803 | A1 | 2/2008 | Yun | |
| 2016/0214421 | A1* | 7/2016 | Furuya | B41J 2/2146 |
| 2017/0341371 | A1* | 11/2017 | Muth | B41J 29/393 |
| 2019/0224964 | A1* | 7/2019 | Mizutani | B41J 2/2146 |

FOREIGN PATENT DOCUMENTS

| | | | |
|---|---|---|---|
| CN | 105599453 | A | 5/2016 |
| CN | 106064529 | A | 11/2016 |
| CN | 108162600 | A | 6/2018 |
| CN | 111231529 | A | 6/2020 |
| DE | 69504458 | T2 | 1/1999 |
| DE | 102017220361 | A1 | 6/2018 |
| EP | 3427957 | A1 | 1/2019 |
| JP | 2005022216 | A | 1/2005 |
| JP | 2015532899 | A | 11/2015 |

* cited by examiner

METHOD FOR ASSESSING THE CONDITION AND IMPROVING THE PRINTING QUALITY OF PRINTING NOZZLES IN PRINTHEADS OF AN INKJET PRINTING MACHINE AND IMPROVED PRINTING NOZZLE TEST CHART

CROSS-REFERENCE TO RELATED APPLICATION

This application claims the priority, under 35 U.S.C. § 119, of German Patent Application DE 10 2019 200 567, filed Jan. 17, 2019; the prior application is herewith incorporated by reference in its entirety.

BACKGROUND OF THE INVENTION

Field of the Invention

The present invention relates to an improved printing nozzle test chart and a method for assessing the condition of printing nozzles in inkjet printheads by using the printing nozzle test chart.

The technical field of the invention is the field of digital printing.

The current condition of printing nozzles in inkjet printheads of inkjet printing machines is of critical importance for the quality an inkjet printing machine can produce. Therefore, the prior art has provided methods of assessing the condition by printing specific test charts to which all relevant printheads and printing nozzles contribute and by analyzing the test charts in a corresponding way. The analysis allows conclusions to be drawn on the current condition of the printing nozzles that contributed to the printing of the test chart. A plurality of possible test charts that are suitable for that purpose has become known in the art. However, a frequent problem is the image resolution of the camera system that is used to record the test chart that has been printed because the resolution thereof is frequently lower than the maximum print resolution of the inkjet printing machine to be tested. That basically means that the image processor that makes the analysis is no longer capable of resolving the image objects that individual printing nozzles contributed to the test chart in order to assess them separately from one another. Therefore, a test chart layout formed of multiple rows of objects printed by individual printing nozzles has become widely used in the art. In that test chart, only every $n^{th}$ printing nozzle of a printhead prints its image objects in every row. In the following row, which is usually disposed underneath the previous one, the $n+x^{th}$ printing nozzles contribute to the print, in the next row further down the $n+y^{th}$ nozzles, etc. until all printing nozzles of the inkjet printheads to be tested contribute to the test chart in question. The test chart that has been created in that way may then easily be resolved by the camera system, and the individual image objects may easily be allocated to the respective printing nozzles. The objects printed by the individual printing nozzles are usually short lines printed in the direction of printing by the contributing printing nozzles. The image processor may then easily analyze those individual lines in terms of specific printing quality parameters of the printing nozzles in question. Individual parameters include the printing strength, also known as the amplitude, of an individual printing nozzle, the deviation of the print dot of an individual nozzle both in the printing direction and in a direction perpendicular to the printing direction, etc.

A problem with the test charts that are currently in use and the associated methods for analysis is the analysis of the phase in the printing direction. Since the signal of the relevant line in the direction of printing is averaged to achieve the required measurement accuracy, a phase error of a printing nozzle in the printing direction is frequently not detected because the signal in the printing direction in the measuring range has a weaker amplitude. Thus, prior art test charts and methods of analysis make it difficult to assess the condition of the printing nozzles in the inkjet printheads in terms of that parameter.

SUMMARY OF THE INVENTION

It is accordingly an object of the invention to provide a method for assessing the condition and improving the printing quality of printing nozzles in printheads of an inkjet printing machine and an improved printing nozzle test chart, which overcome the hereinafore-mentioned disadvantages of the heretofore-known methods and test charts of this general type in order to provide a better way of detecting and correcting print defects that are caused by phase defects in the printing direction in inkjet printing machines.

With the foregoing and other objects in view there is provided, in accordance with the invention, a method for assessing the condition and improving the printing quality of printing nozzles in printheads of an inkjet printing machine by using a computer, the method comprising the steps of:

- printing at least one nozzle test chart formed of a specific number of horizontal rows of equidistant vertical lines printed periodically and disposed underneath one another, wherein only every $n^{th}$ printing nozzle contributes to the nozzle test chart in every row of the nozzle test chart, with n corresponding to a different number between one and the specific number of horizontal rows for every row,
- recording and digitizing the printed nozzle test chart and analyzing the nozzle test chart in terms of the condition of the contributing printing nozzles by using the computer,
- using the printing nozzles for additionally printing horizontal lines between the horizontal rows, the horizontal lines complementing the equidistant printed vertical lines to form quadrangular objects that are specifically used by the computer to analyze the condition of the contributing printing nozzles, and
- depending on the condition of the contributing printing nozzles, taking measures to improve the printing quality of the printing nozzles.

Like the individual lines known in the art, the quadrangular objects provide information on the condition of the printing nozzles that contribute to the print. The quadrangular objects are formed of such line-shaped objects on the sides while the abutting upper and lower sides are formed of the horizontal lines. Thus, the quadrangular objects are excellent for detecting phase defects in the printing direction because in such a case, the sides of the quadrangular objects in the form of the lines created by the individual printing nozzles have shifted positions and consequently the quadrangular objects are not closed. Therefore, a quadrangle that is not closed is easy to detect and immediately indicates a phase defect in the printing direction.

Advantageous and thus preferred further developments of the method will become apparent from the associated dependent claims and from the description together with the associated drawings.

Another preferred development of the method of the invention in this context is that the computer uses the quadrangular objects to draw conclusions on the condition of the printing nozzles that contribute to the nozzle test chart by applying image processing algorithms to check whether all equidistant lines printed vertically exist by comparing the number of detected quadrangular objects with the number of expected equidistant lines printed vertically, whether the quadrangular objects that have been formed are complete and do not have any gaps, whether the equidistant lines printed vertically have been printed continuously and are not porous, and whether the detected quadrangular objects have the expected regular size.

The method of the invention thus specifically allows the parameter of a phase defect in the printing direction to be analyzed, but also the other parameters such as the amplitude or a phase defect in a direction orthogonal to the printing direction. In addition to the printing strength, in an extreme case the amplitude indicates a complete failure of an individual printing nozzle, i.e. a missing nozzle. The method of the invention makes missing nozzles very easy to detect just by comparing the number of quadrangular objects that have been found and the number of expected equidistant vertical lines, which is in turn identical with the number of printing nozzles that contribute to the print—a number that is known, of course. The individual quadrangular objects are detected by image processing algorithms and only need to be analyzed in terms of their number. Another test is to check whether the quadrangles that have been found are complete, i.e. whether they are closed and have no gaps. This test is an easy way to detect potential phase defects in the printing direction. A general assessment of the amplitude, i.e. the printing strength of the individual printing nozzles, may be made by checking whether the equidistant lines printed vertically and forming the sides of the quadrangle are porous, i.e. whether they are continuous or not. In addition, phase defects against the printing direction may be detected by checking whether the quadrangles that have been found correspond to their regular expected size. If a quadrangle that has been found is approximately twice as big as expected, this directly points to a missing nozzle. Thus, there are two ways to detect missing nozzles, i.e. nozzles that are defective: comparing the number of detected quadrangles and the number of printing nozzles contributing to the print and checking the size of the quadrangles that have been found. The size check may also be used to detect phase defects in a direction orthogonal to the printing direction, because in such a case a quadrangle is smaller than expected, whereas the adjacent quadrangle on the other side of the equidistant vertical line printed by the printing nozzle in question must be correspondingly larger. In such a case, the differences in size of the respective adjacent quadrangles are not in an order of magnitude of twice the size, but in a much smaller size deviation. The size deviation that always occurs in such a case is that one quadrangle is smaller and the adjacent quadrangle larger than expected. This indicates a phase defect in a direction orthogonal to the printing direction.

A further preferred development of the method of the invention in this context is that the horizontal lines are printed at a line thickness of multiple pixels and every contributing printing nozzle applies a larger drop volume. Since the horizontal lines that complement the equidistant lines printed vertically to form the quadrangular objects must in turn not be affected by missing nozzles/defective printing nozzles that may exist, they ought to be printed as lines that are multiple pixels wide. This is achieved in that all contributing printing nozzles, which of course need to print the horizontal lines in addition to the vertical equidistant lines, apply a correspondingly larger ink drop volume to print the horizontal line. Now if an individual nozzle fails, i.e. becomes a missing nozzle, the increased ink drop volume causes the gap in the horizontal lines to be closed by the corresponding adjacent printing nozzles, which thus create a continuous horizontal line and thus a corresponding closed quadrangle. Quadrangles that are not closed may now only occur if a printing nozzle has a phase defect in the printing direction or, in an extreme case, if multiple adjacent missing nozzles occur. However, such cases of multiple adjacent missing nozzles, which have an extremely negative effect on the quality of the print created by the inkjet printing machine, are easy to detect based on the size of the created quadrangles.

An added preferred development of the method of the invention in this context is that the nozzle test chart is recorded by an in-line image processing system and the computer corresponds to the image processor of the in-line image processing system. The analysis of the nozzle chart including the quadrangular objects is made possible in that the nozzle chart is recorded, preferably by an in-line image processing system that includes a camera system, usually disposed downstream of the last printhead inside the inkjet printing machine specifically to record the nozzle chart, and analyzed in a corresponding way by using an image processor connected to the camera system. Of course, an external analysis using a camera outside the printing machine is also conceivable. In this case, the computer may be any computer that receives the recorded test charts. Yet the use of an in-line image processing system that is provided in many printing machines anyway to check the general quality of the print is advantageous because it does not require the use of any additional hardware and because the computer-assisted execution of the method of the invention may easily be integrated into the software-assisted analysis of the printing quality of the image data provided by the image processing system.

An additional preferred development of the method of the invention in this context is that to record the printed nozzle test chart, the nozzle test chart is slightly overexposed to make porous equidistant vertical lines caused by weak nozzles more visible. Such a slight overexposure allows the analysis of the test chart in terms of the parameters of the amplitudes, which manifest themselves in the form of porous equidistant lines, to be considerably improved.

Another preferred development of the method of the invention in this context is that the computer binarizes the recorded and digitized nozzle test chart for analysis in accordance with a dynamically detected threshold and implements object recognition on the basis of the binary image obtained in this way to detect the quadrangular objects. The detection of the individual quadrangular objects is implemented by using specific image processing algorithms for which the aforementioned way to proceed of binarizing the recorded digital image of the test chart and then implementing object recognition on the generated binary image is used. Binarization simplifies object recognition of the quadrangles.

A further preferred development of the method of the invention in this context is that to determine the condition of the printing nozzles that contributed to the nozzle test chart by analyzing the quadrangular objects, an average size of the quadrangular objects is statistically determined and the computer concludes from the existence of a regular quadrangle that a respective printing nozzle works correctly.

Therefore, the condition of the printing nozzles to be tested in the inkjet printing machine may relatively easily be assessed. A regular quadrangle in the printing nozzle test chart, i.e. a quadrangle corresponding to the expected parameters in terms of a closed shape and in terms of the expected average size, allows one to assume that all parameters in terms of amplitude and phase in and orthogonal to the printing direction are within defined values and all contributing printing nozzles work properly.

An added preferred development of the method of the invention in this context is that the measures to improve the printing quality of the printing nozzles include switching off printing nozzles having a condition which is not within desired printing quality parameters and compensating for them by using adjacent printing nozzles and, for printing nozzles having a print dot which deviates in the printing direction, varying the instant in time at which printing takes place. The methods for compensation that are used depend on the options available on the inkjet printing machine in question. Compensation by adjacent printing nozzles has proved to be particularly expedient. In accordance with this method, the ink volumes of the adjacent printing nozzles are increased in a corresponding way to allow ink to flow into the white lines that have been created, thus effectively closing them.

With the objects of the invention in view, there is also provided a nozzle test chart for use in any one of the methods described above. The nozzle test chart of the invention is formed of a specific number of horizontal rows of equidistant vertical lines printed periodically and disposed underneath one another, wherein only every $n^{th}$ printing nozzle contributes to the digital nozzle test chart in each row of the digital nozzle test chart, with n corresponding to a different number between one and the number of horizontal rows in every row. The nozzle test chart is distinguished by the fact that horizontal lines exist between the horizontal rows, with the horizontal lines complementing the equidistant vertical lines to form quadrangular objects.

A concomitant preferred development of the method of the invention in this context is that the horizontal lines have a line thickness of multiple pixels. In the case of the nozzle test chart of the invention, it is likewise true that the horizontal lines that complement the equidistant lines printed vertically to create the quadrangular objects must not be affected by missing/defective printing nozzles that may potentially occur. Therefore, these lines ought to have a line thickness of multiple pixels. As mentioned above, for this purpose, all contributing printing nozzles that need to print the horizontal lines in addition to the equidistant vertical lines apply a correspondingly larger drop volume to print the horizontal line. If an individual printing nozzle becomes a missing nozzle, the gap in the horizontal lines is closed due to the increased ink drop volume applied by the corresponding adjacent printing nozzles, resulting in a continuous horizontal line and thus a closed quadrangle.

Other features which are considered as characteristic for the invention are set forth in the appended claims.

Although the invention is illustrated and described herein as embodied in a method for assessing the condition and improving the printing quality of printing nozzles in printheads of an inkjet printing machine and an improved printing nozzle test chart, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

The invention as such as well as further developments of the invention that are advantageous in structural and/or functional terms will be described in more detail below with reference to the associated drawings and based on at least one preferred exemplary embodiment.

DETAILED DESCRIPTION OF THE INVENTION

Figure 1:
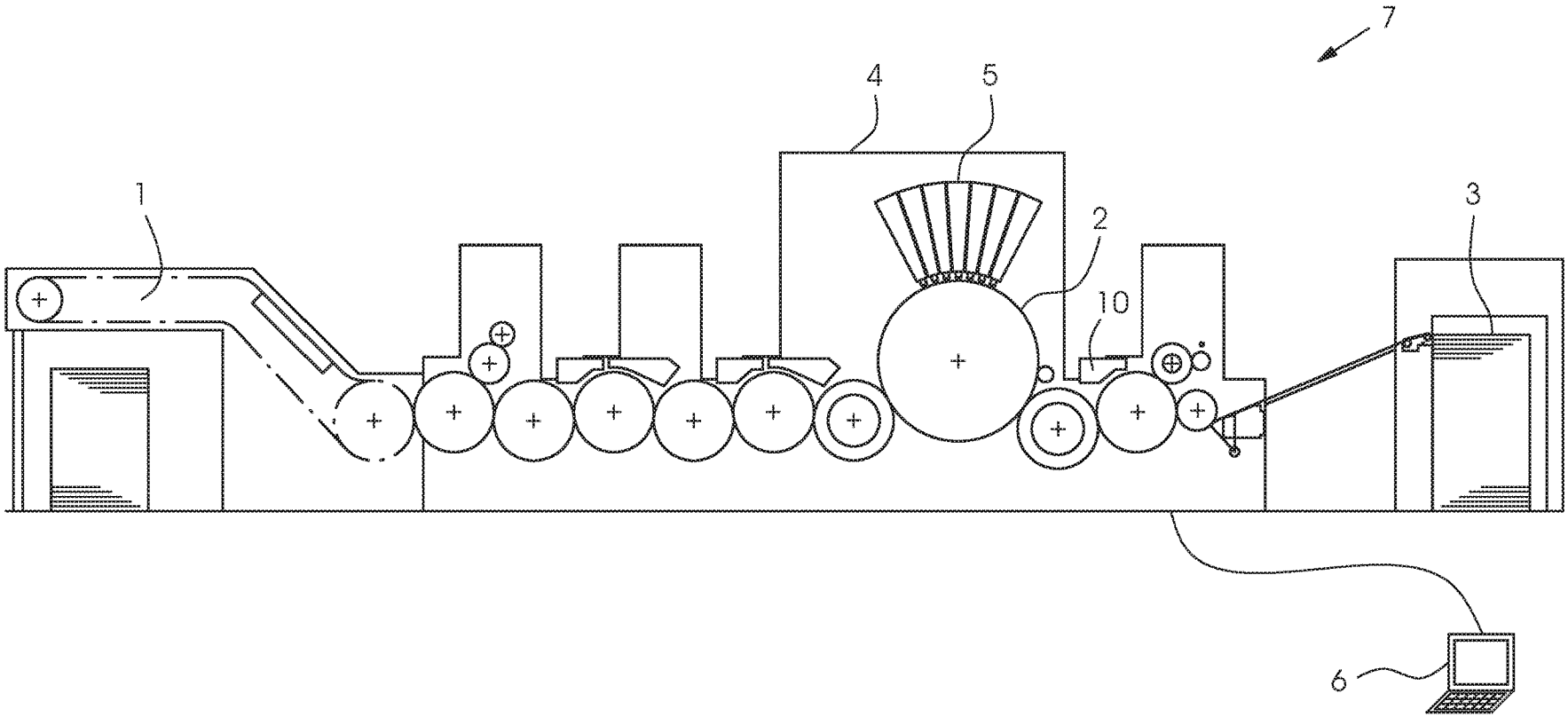
FIG. 1 is a diagrammatic, longitudinal-sectional view of an example of the structure of a sheet-fed inkjet printing machine.
Figure 2:
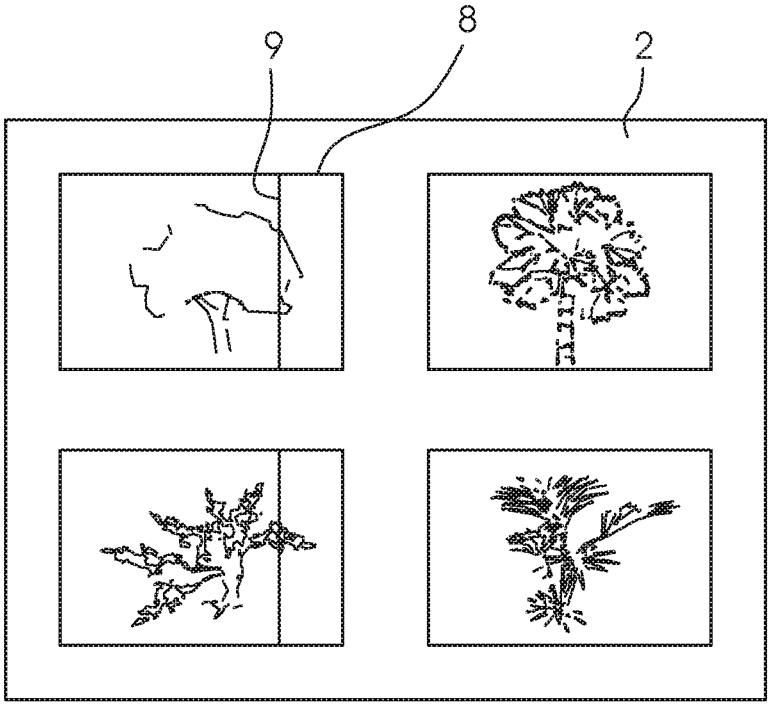
FIG. 2 is a plan view of a printing substrate having a white line caused by a missing nozzle.

Referring now in detail to the figures of the drawings, in which mutually corresponding elements have the same reference symbols, and first, particularly, to FIG. 1 thereof, it is seen that the field of application of the preferred exemplary embodiment is an inkjet printing machine 7. FIG. 1 shows an example of the fundamental construction of such a machine 7, including a feeder 1 for feeding a printing substrate 2 to a printing unit 4, where it receives an image printed by printheads 5, and a delivery 3 receiving the printing substrate 2. The machine is a sheet-fed inkjet printing machine 7 controlled by a control unit, controller or computer 6. While this printing machine 7 is in operation, individual printing nozzles in the printheads 5 in the printing unit 4 may fail as described above. Such a failure results in white lines 9 or, in the case of multicolor printing, in distorted color values. An example of such a white line 9 in a printed image 8 is shown in FIG. 2.

In order to detect such white lines 9, nozzle test charts 11 including multiple objects 12, which are mostly in the form of lines 12 in the printing direction that are printed in multiple rows, are printed at regular intervals. The individual printing nozzles alternatingly contribute to every row of objects 12. A printed nozzle test chart 11*a* is then recorded and digitized and the individual objects 12 are measured and analyzed by the computer 6. Based on the characteristics of the objects 12, the computer 6 assesses a condition 17 of the printing nozzles in terms of parameters such as amplitude and phase. The computer may be the control unit 6 of the printing machine. In most cases, however, it is the computer of an image recording system 10 used to record and digitize the printed nozzle test charts 11*a*. The image recording system 10 is preferably disposed in-line and downstream of the printheads 5 in the inkjet printing machine 7.

Figure 3:
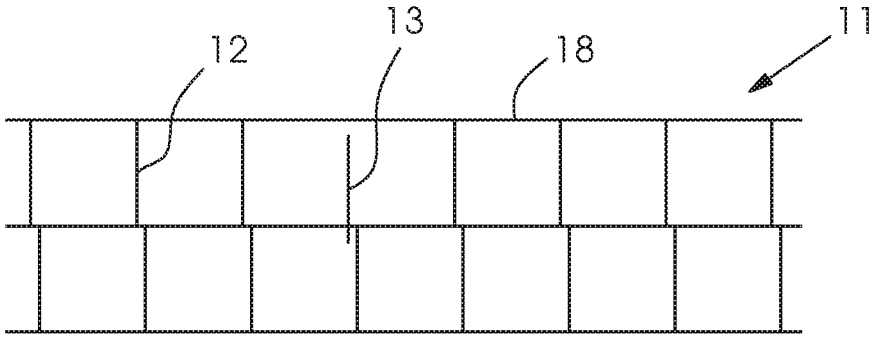
FIG. 3 is a plan view illustrating a section of two rows with an every-$10^{th}$-nozzle pattern in a nozzle test chart.
Figure 7:
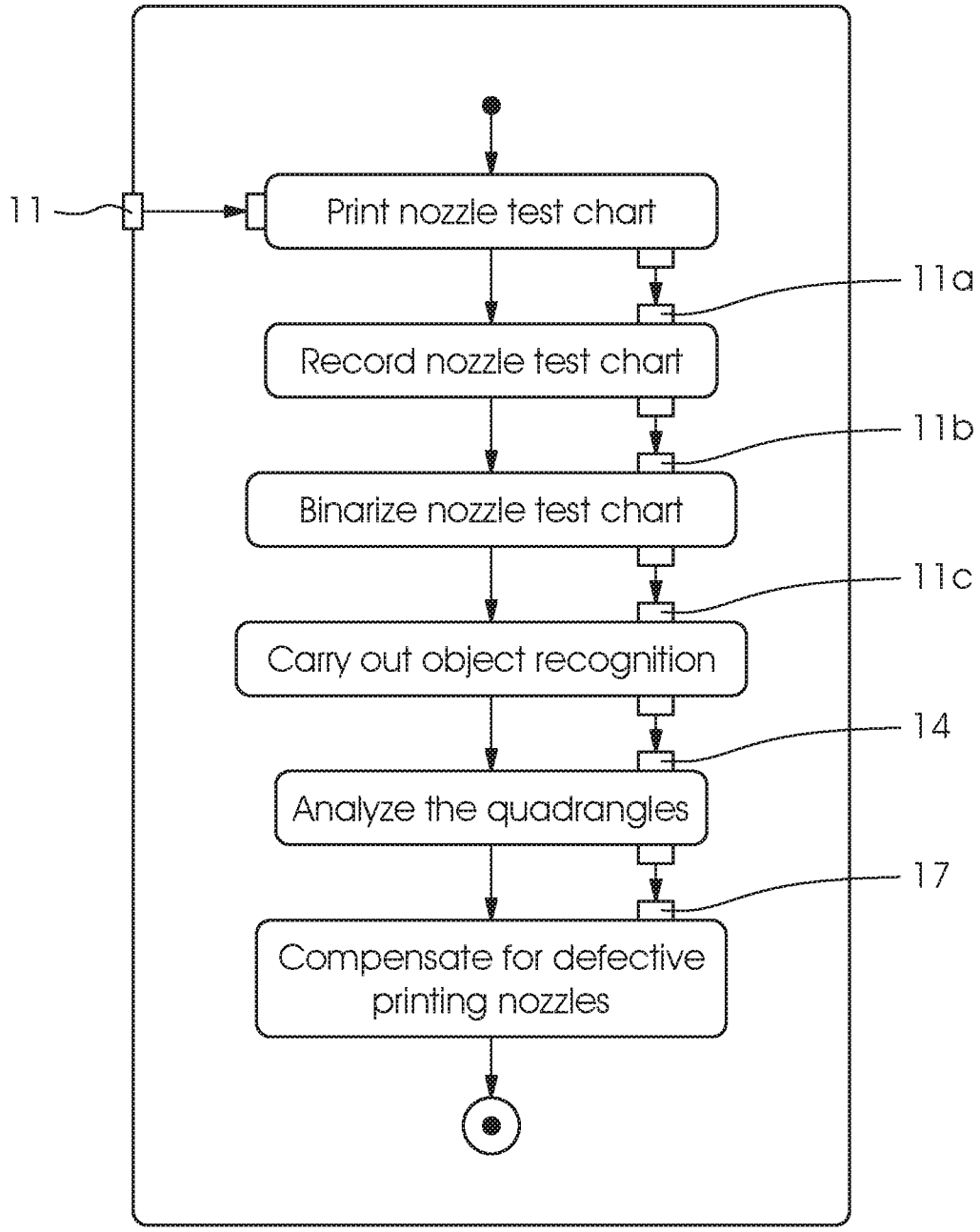
FIG. 7 is a flow chart of the method of the invention.

In terms of analyzing re-digitized nozzle test charts 11*b*, the invention makes use of an image processing effect, namely the object segmentation effect. FIG. 7 is a schematic flow chart of a preferred embodiment of the method of the invention. The nozzle test chart 11 that is used is similar to the line-shaped test chart described above. Every printing nozzle prints a vertical line 12. Since the printing nozzles are spaced apart by a distance N in one row, there are N rows disposed underneath one another. The printing nozzle prints a small available dot. In addition, the entirety of the nozzles seamlessly prints horizontal lines 18 between the rows between the vertical lines/stripes 12 disposed in rows. These lines 18 are formed of multiple pixels. If necessary, a larger ink volume is used for these pixels, causing the printing nozzles to print a large dot. This prevents missing printing nozzles from creating gaps in the horizontal lines 18. In a regular case, the horizontal lines 18 complement the vertical lines 12 to form quadrangles 14 in the nozzle test chart 11. This is shown by way of example in FIG. 3. Prior art methods do not include this horizontal line 18. It is true that there are prior art methods that may have horizontal lines, but those horizontal lines are optionally used for a better distinction between the rows of stripes and they do not form closed quadrangles 14 in the nozzle test chart 11. The printed nozzle test chart 11*a* is then recorded by the image recording system 10. The image recording system preferably slightly overexposes the nozzle test chart to make porous lines printed by weak nozzles more pronounced. Then a computer 6 binarizes the re-digitized nozzle test chart 11*b* in accordance with a dynamically detected threshold to obtain a binarized nozzle test chart 11*c* that is easier to analyze.

Figure 4:
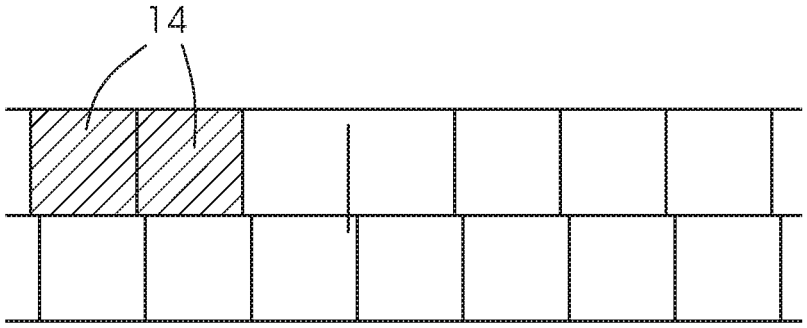
FIG. 4 is a plan view illustrating an object detection of quadrangles in a section.
Figure 5:
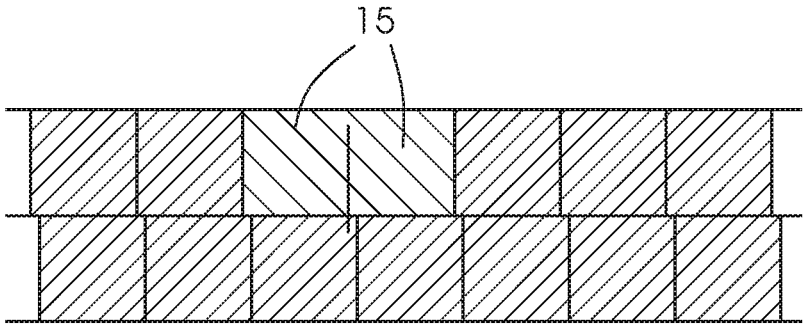
FIG. 5 is a plan view illustrating a detection of a phase defect by using a defective quadrangle.

Then the computer 6 specifically looks for and analyzes the quadrangles 14 in the binarized nozzle test chart 11*c* by using image processing algorithms. For this purpose, the average size of the quadrangles 14 is calculated statistically as shown in FIG. 4. Specific printing nozzle conditions 17 result in specific defects in the quadrangles 14. For instance, if a printing nozzle fails completely, no line 12 is printed and the expected closed quadrangle 14 is not formed at this location in the nozzle test chart. Instead, the computer 6 will find a quadrangle that is approximately twice the expected size and may thus conclude that the nozzle in question is defective. However, if the nozzle has a phase defect 13, i.e. if it exhibits a deviation in the Y/printing direction, there will be no closed quadrangle 14 because a gap is created, as seen in FIG. 5. Instead, an open quadrangle 15 is created. Thus, the computer 6 or rather the image processing algorithm realizes that there is no closed quadrangle 14 but a different object 15 distinguished from an expected regular quadrangle 14 and may conclude that there is a phase defect 13. If a printing nozzle defect causes a nozzle to print intermittently, the resultant amplitude defect may be detected due to a porous vertical line, i.e. a line that is not continuous. If a printing nozzle prints at an angle in the x direction, i.e. in a direction transverse to the printing direction, two closed quadrangles 14 that deviate slightly from the regular size are created. If the printing nozzle slightly deviates to the left, the quadrangle 14 to the left is slightly smaller. If the printing nozzle deviates to the right, the quadrangle 14 to the right is correspondingly smaller. Deviations of the contributing printing nozzles may be detected based on these size deviations of the quadrangles 14.

Missing printing nozzles, amplitude defects, and phase defects in the x direction may in principle be detected by using normal printing nozzle test charts without the quadrangles of the invention. A major advantage of the nozzle test chart 11 of the invention including quadrangles 14 and of the method of the invention for analyzing the latter is a much more efficient detection of phase defects 13 in the y direction. Such defects are difficult or even impossible to detect using conventional nozzle test charts.

Figure 6:
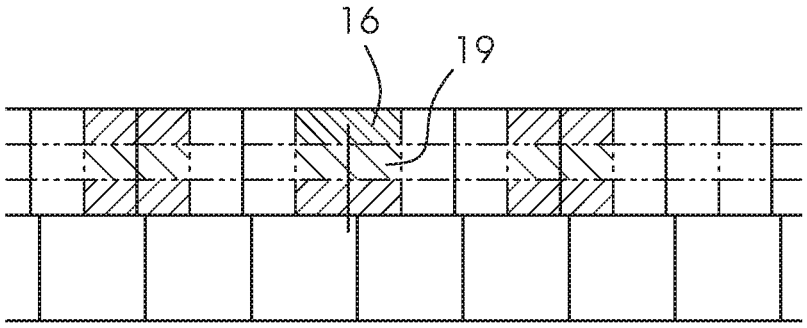
FIG. 6 is a plan view illustrating an object detection of a phase defect by using a segmented defective quadrangle.

Moreover, the embodiment pertaining to object recognition of the quadrangles 14 described above, in particular for detecting phase defects 13 in the y-direction, may even be further improved. This is done in a further preferred embodiment in which the computer 6 divides the nozzle chart rows into smaller horizontal areas 16 as shown in FIG. 6. The computer 6 determines an amplitude signal for every area 16 and analyzes it as follows: the cell in which the vertical printing nozzle line 12 is expected is used to determine the amplitude signal. If necessary, only an inner region 19 of a nozzle line is used to determine the signal to prevent the horizontal lines 18 from interfering with the signal. The inner area 19 of the cell is the area in which the vertical printing nozzle line 12 is expected. Then the inner area 19 is horizontally divided into area parts. If the free area around the horizontal lines 18 is used, too, or if an area part is used to determine an amplitude signal, the amplitude signal generally ought to be of the same strength or even stronger due to interference. However, if the amplitude signal in one of the two area parts at the horizontal separators is weaker than the actual inner region 19 for determining the amplitude signal, this indicates a phase defect 13 of the printing nozzle.

LIST OF REFERENCE NUMERALS

1 feeder
2 current printing substrate/current print sheet
3 delivery
4 inkjet printing unit
5 ink jet printhead
6 computer
7 inkjet printing machine
8 printed image on the current print sheet
9 white line
10 in-line image recording system
11 nozzle test chart
11*a* printed nozzle test chart
11*b* recorded re-digitized nozzle test chart
11*c* binarized nozzle test chart
12 vertical printing nozzle line
13 printing nozzle line with a phase defect in the printing direction
14 closed quadrangle detected by object recognition
15 open quadrangle
16 smaller region for analysis in the quadrangle
17 established printing nozzle condition
18 horizontal line in the nozzle test chart
19 inner region for determining the amplitude signal

The invention claimed is:

1. A method for assessing the condition and improving the printing quality of printing nozzles in printheads of an inkjet printing machine, the method comprising the following steps:

printing at least one nozzle test chart formed of a specific number of horizontal rows of equidistant vertical lines printed periodically and disposed underneath one another, with only every $n^{th}$ printing nozzle in a width direction of a printhead contributing to the nozzle test chart in each respective row of the nozzle test chart and with n corresponding to a different number between one and the specific number of horizontal rows for every row;

using a computer to record and digitize the printed nozzle test chart and analyze the nozzle test chart in terms of a condition of contributing printing nozzles;

using the printing nozzles to additionally print horizontal lines between the horizontal rows, the horizontal lines complementing the equidistant printed vertical lines to form quadrangular objects being specifically used by the computer to analyze the condition of the contributing printing nozzles;

using the computer to employ the quadrangular objects to draw conclusions on the condition of the printing nozzles that contribute to the nozzle test chart by applying image processing algorithms to check:

whether all equidistant lines printed vertically exist by comparing the number of detected quadrangular objects to the number of expected equidistant lines printed vertically, whether the quadrangular objects that have been formed are complete and do not have any gaps, whether the equidistant lines printed vertically have been printed continuously and are not porous, and whether the detected quadrangular objects have an expected regular size; and then taking measures to improve the printing quality of the printing nozzles depending on the condition of the contributing printing nozzles.

2. The method according to claim 1, which further comprises using an in-line image processing system to record the printed nozzle test chart, the computer corresponding to an image processor of the in-line image processing system.

3. The method according to claim 1, which further comprises carrying out the measures to improve the printing quality of the printing nozzles by switching off printing nozzles having a condition not within desired printing quality parameters and compensating for those printing nozzles by using adjacent printing nozzles and, for printing nozzles having a print dot deviating in a printing direction, varying an instant in time at which printing takes place.

4. A method for assessing the condition and improving the printing quality of printing nozzles in printheads of an inkjet printing machine, the method comprising the following steps:

printing at least one nozzle test chart formed of a specific number of horizontal rows of equidistant vertical lines printed periodically and disposed underneath one another, with only every $n^{th}$ printing nozzle in a width direction of a printhead contributing to the nozzle test chart in each respective row of the nozzle test chart and with n corresponding to a different number between one and the specific number of horizontal rows for every row;

using a computer to record and digitize the printed nozzle test chart and analyze the nozzle test chart in terms of a condition of contributing printing nozzles;

using the printing nozzles to additionally print horizontal lines between the horizontal rows, the horizontal lines complementing the equidistant printed vertical lines to form quadrangular objects being specifically used by the computer to analyze the condition of the contributing printing nozzles;

printing the horizontal lines with a line thickness of multiple pixels and every contributing printing nozzle applying a larger ink drop volume than an ink drop volume applied for the vertical lines; and then taking measures to improve the printing quality of the printing nozzles depending on the condition of the contributing printing nozzles.

5. A method for assessing the condition and improving the printing quality of printing nozzles in printheads of an inkjet printing machine, the method comprising the following steps:

printing at least one nozzle test chart formed of a specific number of horizontal rows of equidistant vertical lines printed periodically and disposed underneath one another, with only every $n^{th}$ printing nozzle in a width direction of a printhead contributing to the nozzle test chart in each respective row of the nozzle test chart and with n corresponding to a different number between one and the specific number of horizontal rows for every row;

using a computer to record and digitize the printed nozzle test chart and analyze the nozzle test chart in terms of a condition of contributing printing nozzles;

carrying out the step of recording the printed nozzle test chart by slightly overexposing the nozzle test chart to make porous equidistant vertical lines caused by weak nozzles more visible;

using the printing nozzles to additionally print horizontal lines between the horizontal rows, the horizontal lines complementing the equidistant printed vertical lines to form quadrangular objects being specifically used by the computer to analyze the condition of the contributing printing nozzles; and then taking measures to improve the printing quality of the printing nozzles depending on the condition of the contributing printing nozzles.

6. A method for assessing the condition and improving the printing quality of printing nozzles in printheads of an inkjet printing machine, the method comprising the following steps:

printing at least one nozzle test chart formed of a specific number of horizontal rows of equidistant vertical lines printed periodically and disposed underneath one another, with only every $n^{th}$ printing nozzle in a width direction of a printhead contributing to the nozzle test chart in each respective row of the nozzle test chart and with n corresponding to a different number between one and the specific number of horizontal rows for every row;

using a computer to record and digitize the printed nozzle test chart and analyze the nozzle test chart in terms of a condition of contributing printing nozzles;

using the printing nozzles to additionally print horizontal lines between the horizontal rows, the horizontal lines complementing the equidistant printed vertical lines to form quadrangular objects being specifically used by the computer to analyze the condition of the contributing printing nozzles;

using the computer to binarize the recorded and digitized nozzle test chart for analysis by the computer in accordance with a dynamically detected threshold and using the computer to implement object recognition based on the thus obtained binarized nozzle test chart to detect the quadrangular objects; and then taking measures to improve the printing quality of the printing nozzles depending on the condition of the contributing printing nozzles.

7. The method according to claim 6, which further comprises determining the condition of the printing nozzles contributing to the nozzle test chart by analyzing the quadrangular objects, statistically determining an average size of the quadrangular objects, and using the computer to conclude from an existence of a regular quadrangle that a respective printing nozzle works correctly.

* * * * *